US012258681B2

(12) United States Patent
Ford et al.

(10) Patent No.: US 12,258,681 B2
(45) Date of Patent: Mar. 25, 2025

(54) SAW GIN STAND SAFETY ASSEMBLY

(71) Applicant: Ford Gin Services Inc., Lubbock, TX (US)

(72) Inventors: Danny J Ford, Lubbock, TX (US); Daniel Lloyd Ford, Lubbock, TX (US)

( * ) Notice: Subject to any disclaimer, the term of this patent is extended or adjusted under 35 U.S.C. 154(b) by 0 days.

(21) Appl. No.: 18/498,021

(22) Filed: Oct. 30, 2023

(65) Prior Publication Data

US 2024/0060214 A1 Feb. 22, 2024

Related U.S. Application Data

(63) Continuation-in-part of application No. 17/808,107, filed on Jun. 21, 2022, now abandoned.

(60) Provisional application No. 63/212,467, filed on Jun. 18, 2021.

(51) Int. Cl.
*D01B 1/08* (2006.01)
*D01G 23/04* (2006.01)

(52) U.S. Cl.
CPC ..... *D01B 1/08* (2013.01); *D01G 23/04* (2013.01)

(58) Field of Classification Search
CPC ... D01B 1/04; D01B 1/06; D01B 1/08; D01G 23/04
See application file for complete search history.

(56) References Cited

U.S. PATENT DOCUMENTS

| | | | | |
|---|---|---|---|---|
| 6,061,875 | A | 5/2000 | Laird | |
| 6,263,545 | B1 | 7/2001 | Pinto | |
| 6,460,223 | B1 | 10/2002 | Pinto | |
| 7,325,277 | B2 | 2/2008 | Pinto | |
| 7,707,692 | B2 | 5/2010 | Thomas | |
| 7,810,217 | B2 | 10/2010 | Cory | |
| 2006/0248685 | A1* | 11/2006 | Isbell | D01B 1/04 19/40 |
| 2007/0163087 | A1* | 7/2007 | Pinto | D04H 1/72 19/105 |
| 2009/0271952 | A1* | 11/2009 | Thomas | D01B 1/06 19/39 |
| 2021/0148008 | A1* | 5/2021 | Cory | G01K 13/08 |

* cited by examiner

*Primary Examiner* — Shaun R Hurley
(74) *Attorney, Agent, or Firm* — Shannon Warren

(57) ABSTRACT

A saw gin stand safety assembly for holding a fibrous material for ginning with a rotating ginning equipment. The saw gin stand safety assembly comprises an outer shell, a throat, a picker-agitator motor, an amperage draw sensor and the rotating ginning equipment. The rotating ginning equipment comprises at least a picker roller. The amperage draw sensor monitors a power usage of the picker-agitator motor. The saw gin stand safety assembly is configured to adjust an RPM of the picker-agitator motor according to an amperage draw signal generated by the amperage draw sensor. The throat is configured for holding the fibrous material comprising cotton during the ginning process. The saw gin stand safety assembly further comprises the amperage draw sensor. The saw gin stand safety assembly is configured to adjust the RPM of the picker-agitator motor to avoid choaking of the fibrous material in the rotating ginning equipment and the throat.

17 Claims, 8 Drawing Sheets

Prior Art

500

SAW GIN STAND SAFETY ASSEMBLY

CROSS-REFERENCE TO RELATED APPLICATIONS

This application claims benefit to, and incorporates by reference, U.S. provisional patent application 63/212,467 filed 2021 Jun. 18, and U.S. nonprovisional application Ser. No. 17/808,107 filed 2022 Jun. 21. Further, application '107 comprises the parent application to this continuation-in-part.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art that should preempt the current claims is known to the Applicant. However, these references are cited in the parent application's Office Action and are also included in the IDS provided with this application: U.S. Pat. Nos. 7,810,217, 7,707,692, 7,325,277, 6,061,875, 6,263,545, 6,460,223, and 157,966.

BRIEF SUMMARY OF THE INVENTION

A saw gin stand safety assembly for holding a fibrous material for ginning with a rotating ginning equipment. Said saw gin stand safety assembly comprises an outer shell, a throat, a picker-agitator motor, an amperage draw sensor and said rotating ginning equipment. Said rotating ginning equipment comprises at least a picker roller. Said amperage draw sensor monitors a power usage of said picker-agitator motor. Said saw gin stand safety assembly is configured to adjust an RPM of said picker-agitator motor according to an amperage draw signal generated by said amperage draw sensor. Said throat is configured for holding said fibrous material comprising cotton during the ginning process. Said saw gin stand safety assembly is configured for receiving said fibrous material in a portion of said throat, channeling said fibrous material downward through said throat into said rotating ginning equipment, rotating said picker-agitator motor, monitoring said amperage draw signal from said amperage draw sensor, and adjusting said RPM of said picker-agitator motor according to said amperage draw signal. Said saw gin stand safety assembly further comprises said amperage draw sensor. Said saw gin stand safety assembly is configured to adjust said RPM of said picker-agitator motor to avoid choaking of said fibrous material in said rotating ginning equipment and said throat. Said saw gin stand safety assembly comprises said picker roller and an agitator attached to and driven by said picker-agitator motor. Said picker-agitator motor is configured to drive said picker roller and said agitator separate from other portions of said saw gin stand safety assembly. Wherein, monitoring a load and adjusting a speed of said picker-agitator motor, can vary a feed rate of said fibrous material being fed into said saw gin stand safety assembly, without slowing a saw blade and a blade cleaning brush assembly.

Said saw gin stand safety assembly for holding said fibrous material for ginning with said rotating ginning equipment. Said saw gin stand safety assembly comprises said outer shell, said throat, said picker-agitator motor, said amperage draw sensor and said rotating ginning equipment. Said rotating ginning equipment comprises at least said picker roller. Said amperage draw sensor monitors a power usage of said picker-agitator motor. Said saw gin stand safety assembly is configured to adjust said RPM of said picker-agitator motor according to said amperage draw signal generated by said amperage draw sensor. Said throat is configured for holding said fibrous material comprising cotton during the ginning process. Said saw gin stand safety assembly is configured for receiving said fibrous material in a portion of said throat, channeling said fibrous material downward through said throat into said rotating ginning equipment, rotating said picker-agitator motor, monitoring said amperage draw signal from said amperage draw sensor, and adjusting said RPM of said picker-agitator motor according to said amperage draw signal.

Said saw gin stand safety assembly for holding said fibrous material for ginning with said rotating ginning equipment. Said saw gin stand safety assembly comprises said outer shell, said throat, said picker-agitator motor, said amperage draw sensor and said rotating ginning equipment. Said rotating ginning equipment comprises at least said picker roller. Said amperage draw sensor monitors a power usage of said picker-agitator motor. Said saw gin stand safety assembly is configured to adjust said RPM of said picker-agitator motor according to said amperage draw signal generated by said amperage draw sensor. Said throat is configured for holding said fibrous material comprising cotton during the ginning process. Said saw gin stand safety assembly is configured for receiving said fibrous material in a portion of said throat, channeling said fibrous material downward through said throat into said rotating ginning equipment, rotating said picker-agitator motor, monitoring said amperage draw signal from said amperage draw sensor, and adjusting said RPM of said picker-agitator motor according to said amperage draw signal. Said saw gin stand safety assembly comprises said picker roller and said agitator attached to and driven by said picker-agitator motor. Said picker-agitator motor is configured to drive said picker roller and said agitator separate from other portions of said saw gin stand safety assembly. Wherein, monitoring a load and adjusting a speed of said picker-agitator motor, can vary a feed rate of said fibrous material being fed into said saw gin stand safety assembly, without slowing said saw blade and said blade cleaning brush assembly.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
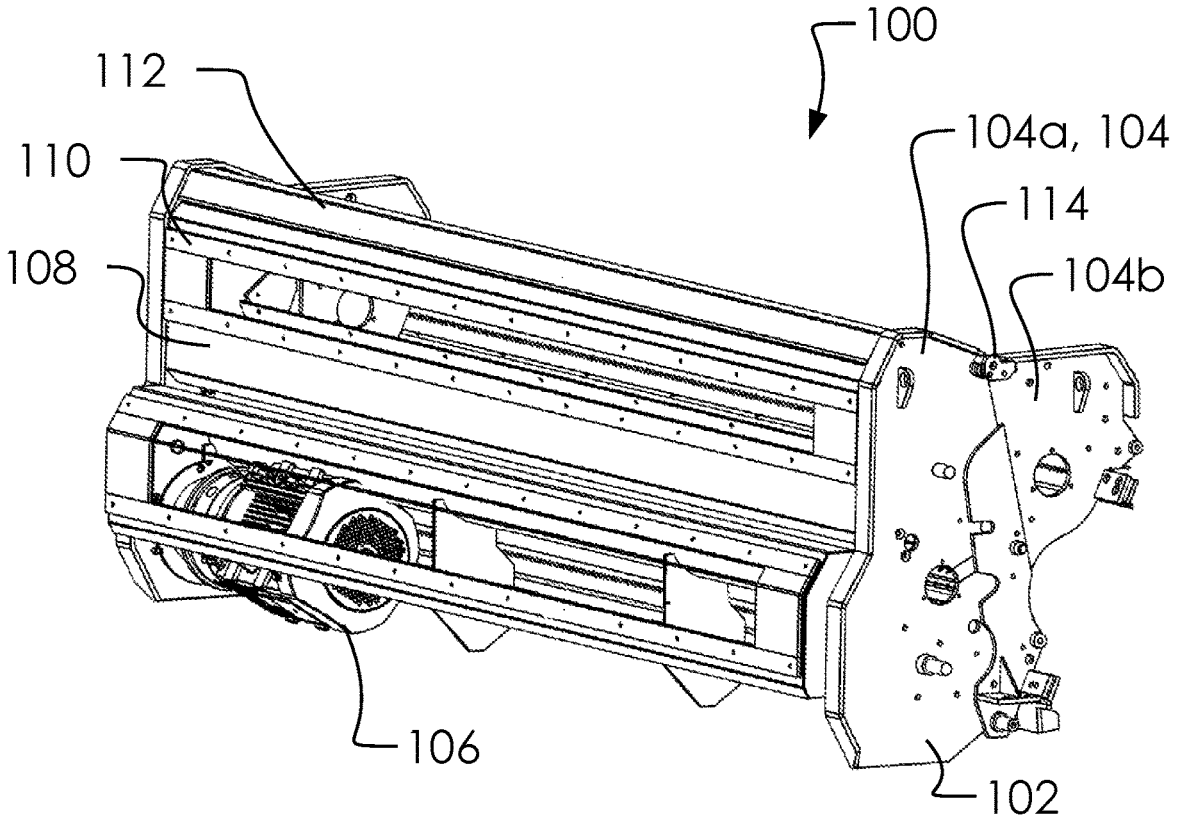
FIG. 1 illustrates a perspective overview of a saw gin stand safety assembly 100.

FIG. 1 illustrates a perspective overview of a saw gin stand safety assembly 100.

In one embodiment, said saw gin stand safety assembly 100 can comprise an outer shell 102, a plurality of side panels 104 (which can comprise a first side panels 104*a*, and a second side panels 104*b*), a picker-agitator motor 106, a front panel 108, a frame 110, a hinged lid 112 having two hinges 114.

In one embodiment, said gin stand can comprise a huller gin stand, as is known in the art.

Figure 2:
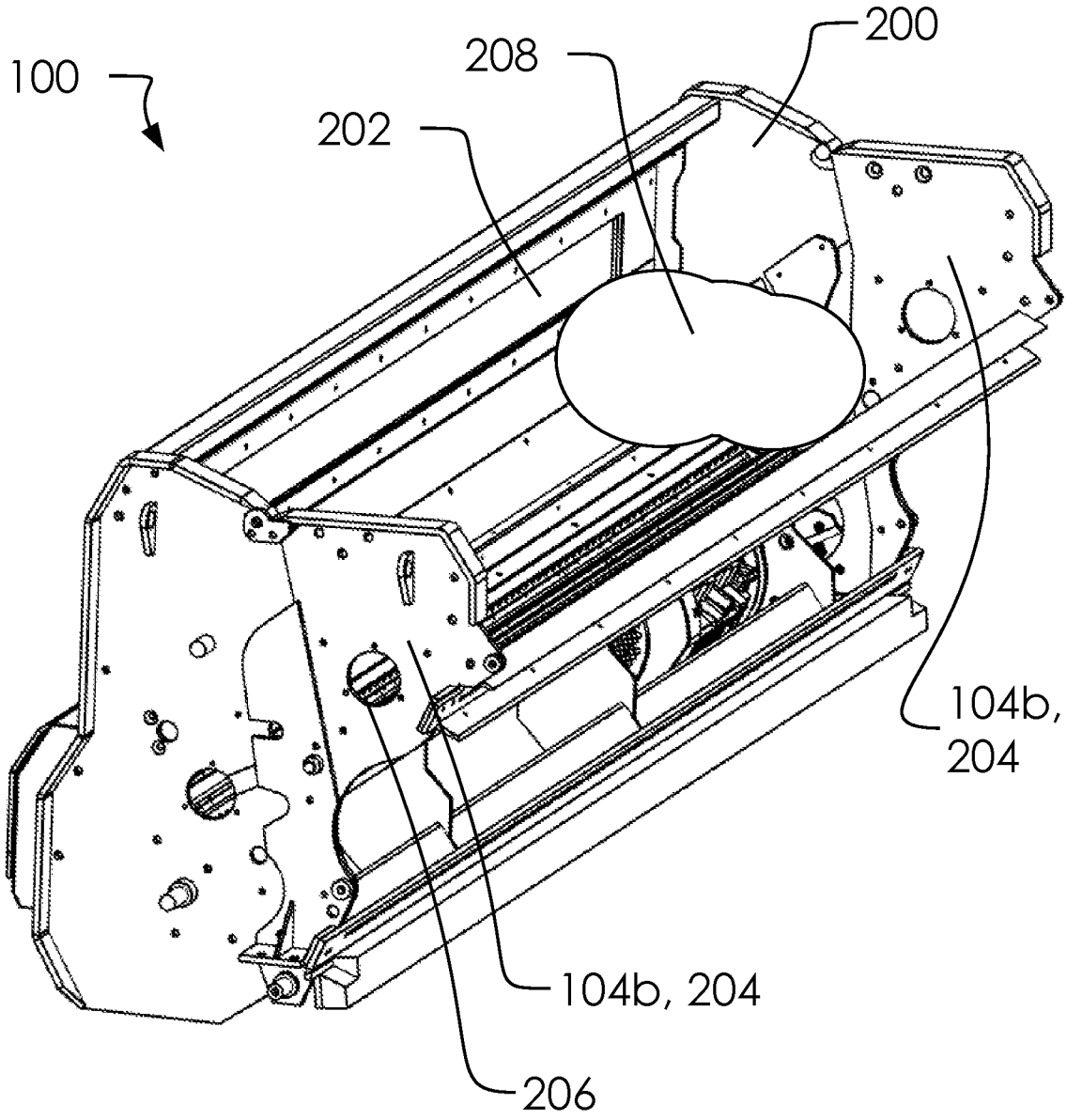
FIG. 2 illustrates a perspective rear view of said saw gin stand safety assembly 100 with a hinged lid 112 removed.

FIG. 2 illustrates a perspective rear view of said saw gin stand safety assembly 100 with said hinged lid 112 removed.

Said saw gin stand safety assembly 100 can further comprise a throat 200 for holding a fibrous material 208 such as cotton during the ginning process, and a front window 202 in said hinged lid 112. Further wherein, by altering the size of said throat 200, said saw gin stand safety assembly 100 can accommodate more than 10% increased ginning capacity as compared to the prior art.

In one embodiment, said second side panels 104*b* can comprise two agitator mounting plates 204 on either side of said saw gin stand safety assembly 100. Further, each among said two agitator mounting plates 204 can comprise an agitator mounting aperture 206.

Figure 3:
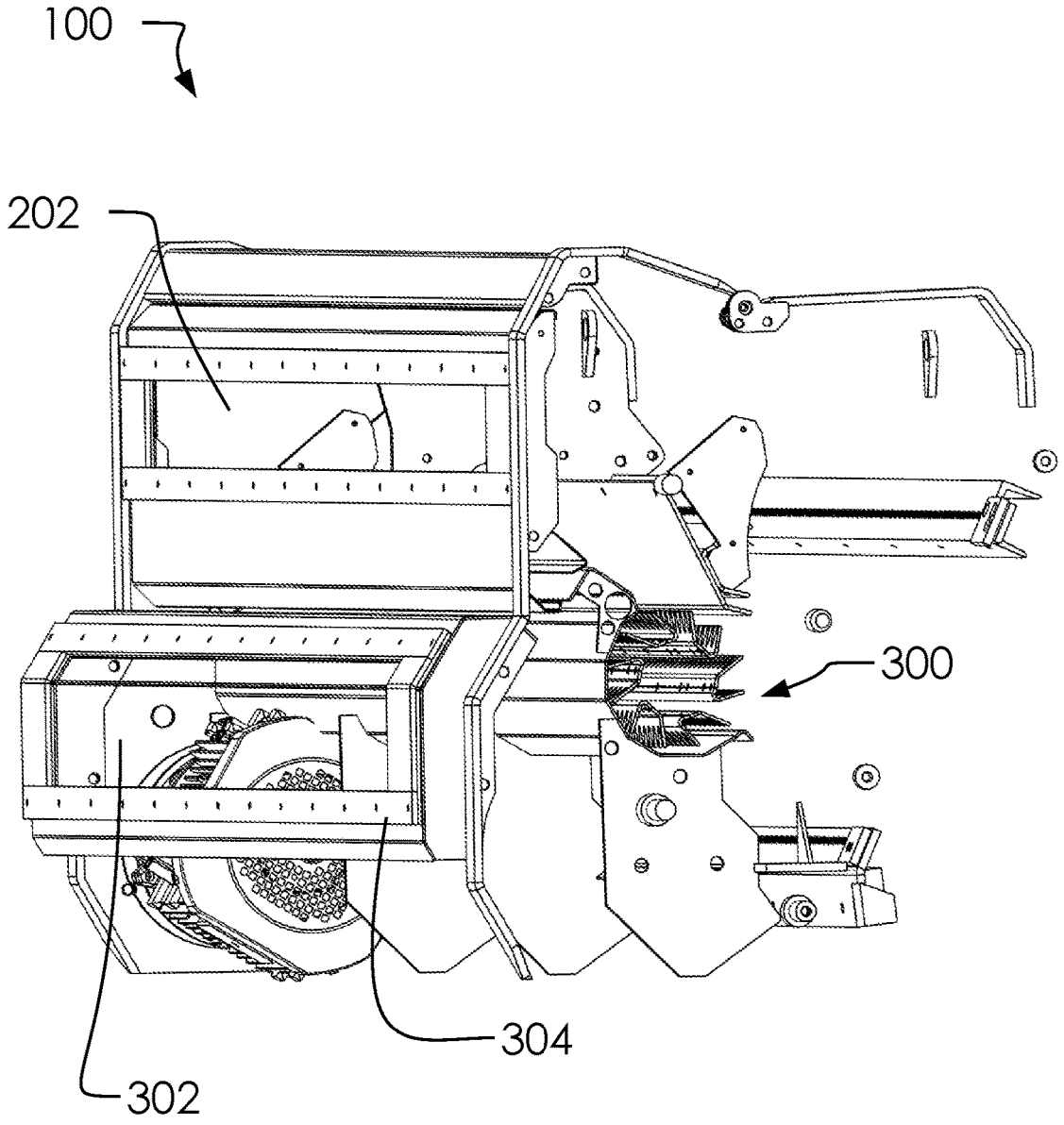
FIG. 3 illustrates a perspective side view of said saw gin stand safety assembly 100 with a plurality of side panels 104 removed.

FIG. 3 illustrates a perspective side view of said saw gin stand safety assembly 100 with said plurality of side panels 104 removed.

Said saw gin stand safety assembly 100 can further comprise a rotating ginning equipment 300, as is known in the art. Said rotating ginning equipment 300 can comprise at least a picker roller 300*a*.

In one embodiment, said saw gin stand safety assembly 100 can further comprise a lower front window 302 in a lower front panel 304. Said lower front window 302 can be arranged to display a status of said saw gin stand safety assembly 100 proximate to said rotating ginning equipment 300 and a lower portion of said throat 200.

Figure 4:
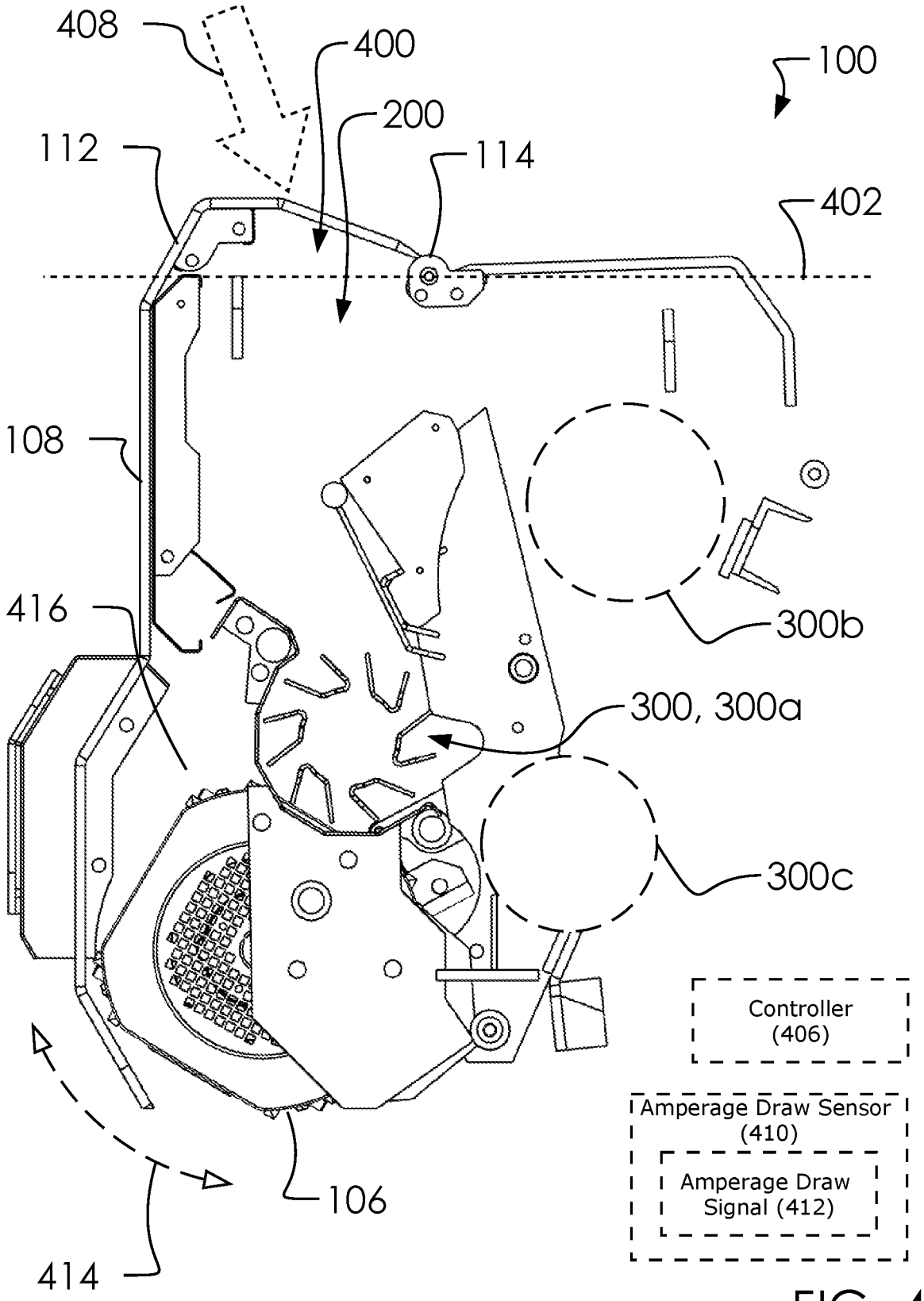
FIG. 4 illustrates an elevated side view of said saw gin stand safety assembly 100 with said plurality of side panels 104 removed.

FIG. 4 illustrates an elevated side view of said saw gin stand safety assembly 100 with said plurality of side panels 104 removed.

As compared to the prior art, said throat 200 can comprise an upper cavity 400. For illustrative purposes, a prior art lid height 402 is shown.

In one embodiment, said upper cavity 400 can be accessed by lifting said hinged lid 112 on said two hinges 114.

In one embodiment, said saw gin stand safety assembly 100 can comprise said throat 200 having said upper cavity 400 comprising a cavity above said two hinges 114.

In one embodiment, said picker-agitator motor 106 can comprise an independent motor on a variable frequency drive.

In one embodiment, said rotating ginning equipment 300 can further comprise an agitator 300*b*, a saw blade 300*c* and a blade cleaning brush assembly 300*d*, as is known in the art.

In one embodiment, said picker-agitator motor 106 can drive said picker roller 300*a* and said agitator 300*b* separate from other portions of said saw gin stand safety assembly 100, such as said saw blade 300*c* and said blade cleaning brush assembly 300*d*. Accordingly, monitoring a load on 106 and adjusting a speed of said picker-agitator motor 106, can vary a feed rate of said fibrous material 208 being fed into said saw gin stand safety assembly 100, without slowing said saw blade 300*c* and said blade cleaning brush assembly 300*d*.

Likewise, said rotating ginning equipment 300 can further comprise an idler in connection with said picker roller 300*a*, said agitator 300*b*, said saw blade 300*c* and said blade cleaning brush assembly 300*d*; wherein, said idler can keep a belt between said rotating ginning equipment 300 tight. This additional part adds needless complexity and chance for damage to said saw gin stand safety assembly 100. Whereas, said saw gin stand safety assembly 100 has eliminated the need for said idler in connection with said picker roller 300*a* and said agitator 300*b*.

In one embodiment, said saw gin stand safety assembly 100 can be configured to mount said picker-agitator motor 106 within said saw gin stand safety assembly 100 and in particular within a lower cavity 416, as illustrated. As shown, said lower cavity 416 is within said front panel 108 and said hinged lid 112. By placing said picker-agitator motor 106 within said lower cavity 416, power can be applied to said picker roller 300*a* and said agitator 300*b* without an idler and lengthy belt, as is known in the art.

Said saw gin stand safety assembly 100 can further comprise a controller 406. In one embodiment, said controller 406 can be used to monitor a load on said picker-agitator motor 106 and modify an input cotton flow 408 and or an RPM 414 of said picker-agitator motor 106 to minimize damage to said saw gin stand safety assembly 100 and said picker-agitator motor 106.

In one embodiment, said saw gin stand safety assembly 100 can further comprise an amperage draw sensor 410. In one embodiment, said amperage draw sensor 410 can be configured for monitoring an amperage draw signal 412 by said picker-agitator motor 106.

In one embodiment, said amperage draw sensor 410 can be configured for reporting an amperage draw signal to said controller 406; wherein, said controller 406 can reduce or increase said RPM 414 of said picker-agitator motor 106 so as to minimize clogs in said rotating ginning equipment 300 and said throat 200.

An additional benefit of said saw gin stand safety assembly 100 can comprise the separation of drive motors from said picker roller 300*a* and said agitator 300*b* from the rest of said saw gin stand safety assembly 100. In so doing, said saw gin stand safety assembly 100 can monitor said picker-agitator motor 106 to ensure a steady flow of said agitator mounting aperture 206 without modifying the RPM of said saw blade 300*c* and said blade cleaning brush assembly 300*d*.

Figure 5:
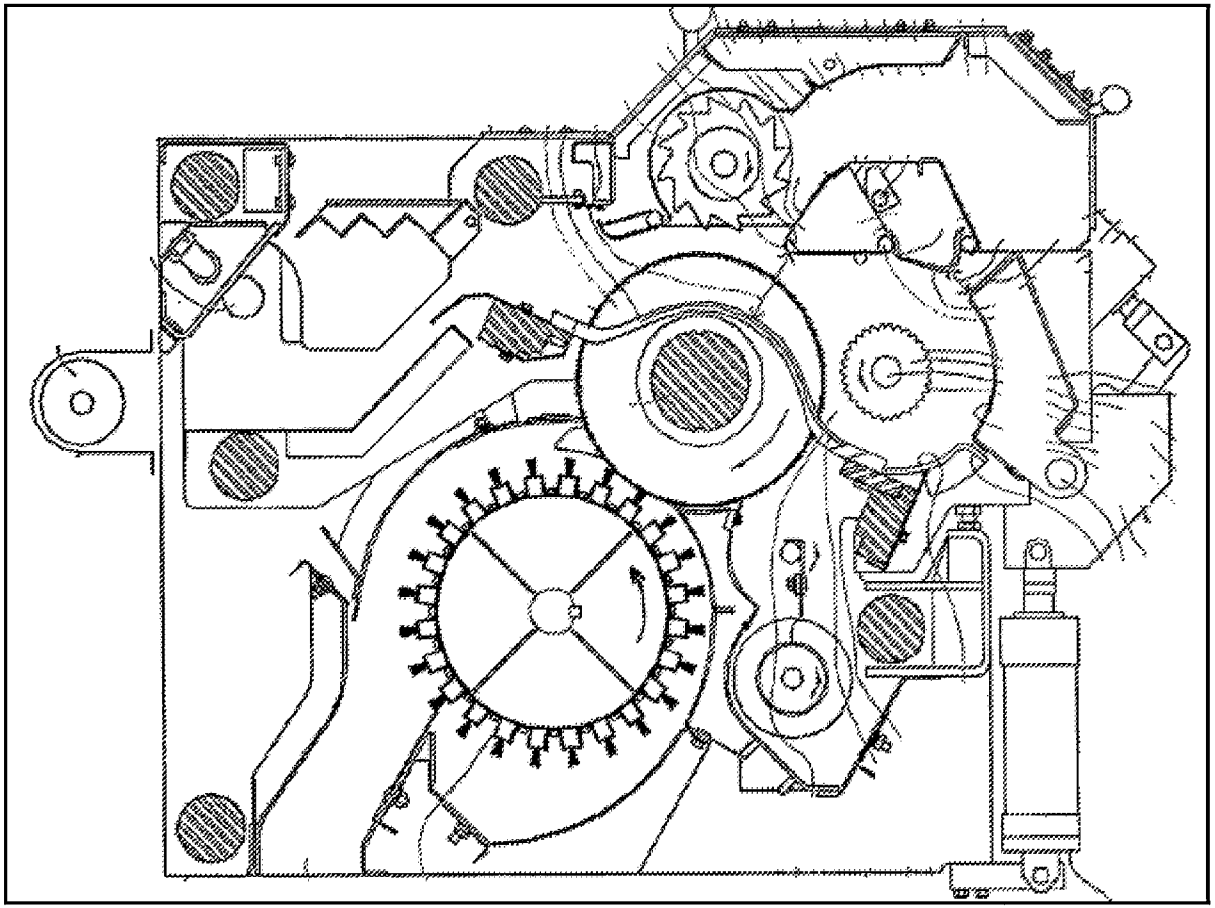
FIG. 5 illustrates a prior art gin stand 500.

FIG. 5 illustrates a prior art gin stand 500.

For illustrative purposes, said prior art gin stand 500 can comprise a representative example of gin stands prior to said saw gin stand safety assembly 100. Novel features of said saw gin stand safety assembly 100 can comprise the addition of said lower front window 302, an increased width and height of said throat 200, programmability of said controller 406.

Said lower front window 302 can function as a fire door for monitoring the status of said input cotton flow 408, which is a fire danger in said saw gin stand safety assembly 100 and said prior art gin stand 500. For example, said prior art gin stand 500 and similar machines are engineered to spin said rotating ginning equipment 300 at 885 RPM, but when seeds are removed from said input cotton flow 408, they can often get caught in said rotating ginning equipment 300 and cause sparks and, ultimately, fire.

By controlling said RPM 414 of said input cotton flow 408 and said rotating ginning equipment 300 with said controller 406, said saw gin stand safety assembly 100 can minimize an amp draw by said saw gin stand safety assembly 100 and thereby increase safety during cotton ginning.

In one embodiment, said throat 200 of said saw gin stand safety assembly 100 can comprise 3 inches additional space between said rotating ginning equipment 300 and said front panel 108 and 3 to 4 inches additional space at the top of said throat 200 in said upper cavity 400. Further, by increasing the size of said throat 200, said saw gin stand safety assembly 100 is configured to gin more cotton.

Figure 6:
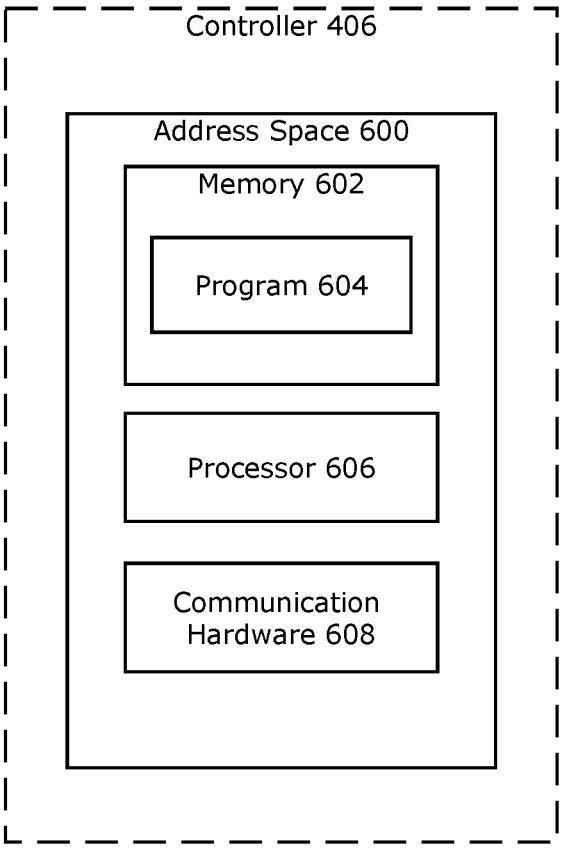
FIG. 6 illustrates a block diagram of an address space 600 of a controller 406.

FIG. 6 illustrates a block diagram of an address space 600 of said controller 406.

Said controller 406 can comprise said address space 600; wherein, said address space 600 can comprise a memory 602 comprising a program 604, a processor 606 and a communication hardware 608.

In one embodiment, said program 604 can be programmed to control various aspects of said saw gin stand safety assembly 100, such as the operation of said picker-agitator motor 106 and said rotating ginning equipment 300.

In one embodiment, said program 604 can be configured for receiving an amperage draw status related to said picker-agitator motor 106; and reducing or increasing said RPM 414 of said picker-agitator motor 106 so as to ensure smooth operation of said saw gin stand safety assembly 100 and to minimize clogs of said fibrous material 208 in said throat 200.

Figure 7:
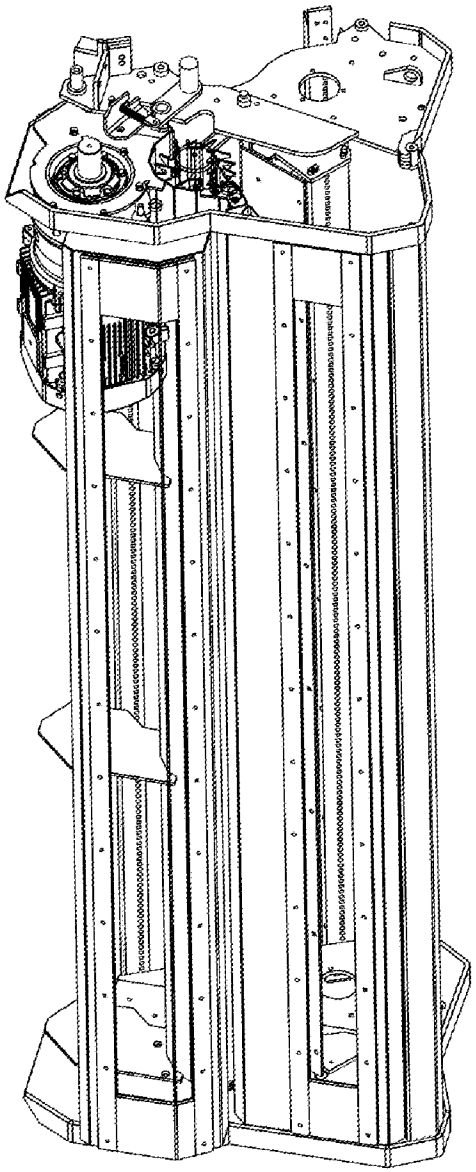
FIG. 7 illustrates a perspective overview of said saw gin stand safety assembly 100.

FIG. 7 illustrates a perspective overview of said saw gin stand safety assembly 100.

Figure 8:
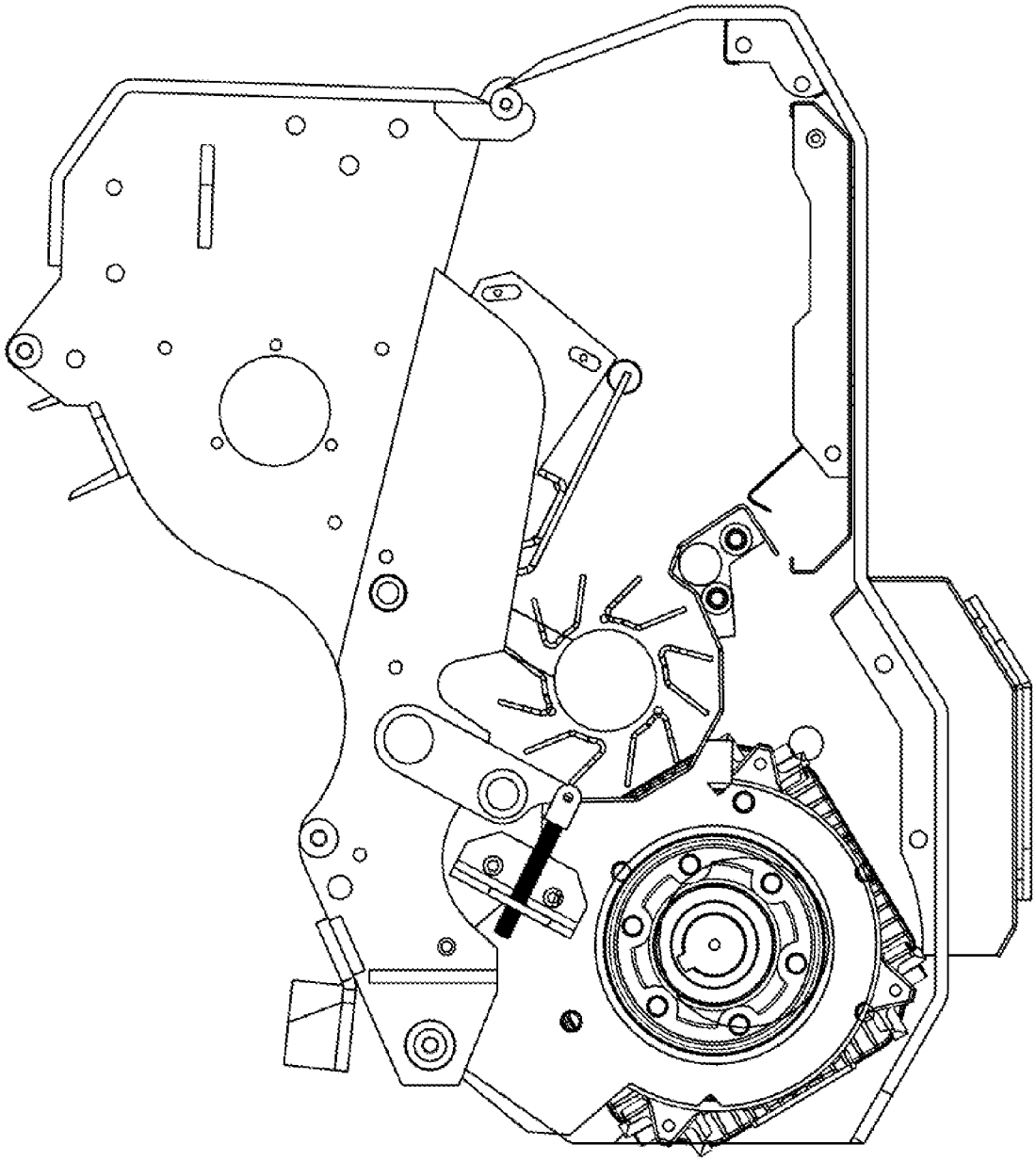
FIG. 8 illustrates elevated side view of said saw gin stand safety assembly 100.

FIG. 8 illustrates elevated side view of said saw gin stand safety assembly 100.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The following paragraphs are included in reference to the claims and can be considered a preferred embodiment.

Said saw gin stand safety assembly 100 for holding said fibrous material 208 for ginning with said rotating ginning equipment 300. Said saw gin stand safety assembly 100 comprises said outer shell 102, said throat 200, said picker-agitator motor 106, said amperage draw sensor 410 and said rotating ginning equipment 300. Said rotating ginning equipment 300 comprises at least said picker roller 300*a*. Said amperage draw sensor 410 monitors a power usage of said picker-agitator motor 106. Said saw gin stand safety assembly 100 can be configured to adjust said RPM 414 of said picker-agitator motor 106 according to said amperage draw signal 412 generated by said amperage draw sensor 410. Said throat 200 can be configured for holding said fibrous material 208 comprising cotton during the ginning process. Said saw gin stand safety assembly 100 can be configured for receiving said fibrous material in a portion of said throat 200, channeling said fibrous material 208 downward through said throat 200 into said rotating ginning equipment 300, rotating said picker-agitator motor 106, monitoring said amperage draw signal 412 from said amperage draw sensor 410, and adjusting said RPM 414 of said picker-agitator motor 106 according to said amperage draw signal 412. Said saw gin stand safety assembly 100 further comprises said amperage draw sensor 410. Said saw gin stand safety assembly 100 can be configured to adjust said RPM 414 of said picker-agitator motor 106 to avoid choaking of said fibrous material 208 in said rotating ginning equipment 300 and said throat 200. Said saw gin stand safety assembly 100 comprises said picker roller 300*a* and said agitator 300*b* attached to and driven by said picker-agitator motor 106. Said picker-agitator motor 106 can be configured to drive said picker roller 300*a* and said agitator 300*b* separate from other portions of said saw gin stand safety assembly 100. Wherein, monitoring a load and adjusting a speed of said picker-agitator motor 106, can vary a feed rate of said fibrous material 208 being fed into said saw gin stand safety assembly 100, without slowing said saw blade 300*c* and said blade cleaning brush assembly 300*d*.

Said saw gin stand safety assembly 100 for holding said fibrous material 208 for ginning with said rotating ginning equipment 300. Said saw gin stand safety assembly 100 comprises said outer shell 102, said throat 200, said picker-agitator motor 106, said amperage draw sensor 410 and said rotating ginning equipment 300. Said rotating ginning equipment 300 comprises at least said picker roller 300*a*. Said amperage draw sensor 410 monitors a power usage of said picker-agitator motor 106. Said saw gin stand safety assembly 100 can be configured to adjust said RPM 414 of said picker-agitator motor 106 according to said amperage draw signal 412 generated by said amperage draw sensor 410. Said throat 200 can be configured for holding said fibrous material 208 comprising cotton during the ginning process. Said saw gin stand safety assembly 100 can be configured for receiving said fibrous material in a portion of said throat 200, channeling said fibrous material 208 downward through said throat 200 into said rotating ginning equipment 300, rotating said picker-agitator motor 106, monitoring said amperage draw signal 412 from said amperage draw sensor 410, and adjusting said RPM 414 of said picker-agitator motor 106 according to said amperage draw signal 412. Said saw gin stand safety assembly 100 further comprises said amperage draw sensor 410. Said saw gin stand safety assembly 100 can be configured to adjust said RPM 414 of said picker-agitator motor 106 to avoid choaking of said fibrous material 208 in said rotating ginning equipment 300 and said throat 200. Said saw gin stand safety assembly 100 comprises said picker roller 300*a* and said agitator 300*b* attached to and driven by said picker-agitator motor 106. Said picker-agitator motor 106 can be configured to drive said picker roller 300*a* and said agitator 300*b* separate from other portions of said saw gin stand safety assembly 100. Wherein, monitoring a load and adjusting a speed of said picker-agitator motor 106, can vary a feed rate of said fibrous material 208 being fed into said saw gin stand safety assembly 100, without slowing said saw blade 300*c* and said blade cleaning brush assembly 300*d*.

Said saw gin stand safety assembly 100 for holding said fibrous material 208 for ginning with said rotating ginning equipment 300. Said saw gin stand safety assembly 100 comprises said outer shell 102, said throat 200, said picker-agitator motor 106, said amperage draw sensor 410 and said rotating ginning equipment 300. Said rotating ginning equipment 300 comprises at least said picker roller 300*a*. Said amperage draw sensor 410 monitors a power usage of said picker-agitator motor 106. Said saw gin stand safety assembly 100 can be configured to adjust said RPM 414 of said picker-agitator motor 106 according to said amperage draw signal 412 generated by said amperage draw sensor 410. Said throat 200 can be configured for holding said fibrous material 208 comprising cotton during the ginning process. Said saw gin stand safety assembly 100 can be configured for receiving said fibrous material in a portion of said throat 200, channeling said fibrous material 208 downward through said throat 200 into said rotating ginning equipment 300, rotating said picker-agitator motor 106, monitoring said amperage draw signal 412 from said amperage draw sensor 410, and adjusting said RPM 414 of said picker-agitator motor 106 according to said amperage draw signal 412.

Said picker-agitator motor 106 and said rotating ginning equipment 300 can be in a direct drive relationship.

Said saw gin stand safety assembly 100 further comprises said amperage draw sensor 410. Said saw gin stand safety assembly 100 can be configured to adjust said RPM 414 of said picker-agitator motor 106 to avoid choaking of said fibrous material 208 in said rotating ginning equipment 300 and said throat 200.

Said controller 406 comprises said address space 600. Said address space 600 comprises said memory 602 comprising said program 604, said processor 606 and said communication hardware 608. Said program 604 can be configured for receiving said amperage draw signal 412 related to said picker-agitator motor 106. Calculating a change in said RPM 414 of said picker-agitator motor 106 to ensure smooth operation of said saw gin stand safety assembly 100 and to minimize clogs of said fibrous material 208 in said throat 200.

Said saw gin stand safety assembly 100 further comprises said amperage draw sensor 410. Said amperage draw sensor 410 can be configured for monitoring power usage by said picker-agitator motor 106. Said amperage draw sensor 410 can be configured for reporting an amperage draw signal to said controller 406. Said controller 406 can reduce or increase said RPM 414 of operation of said picker-agitator motor 106 to minimize clogs of said fibrous material 208 in said rotating ginning equipment 300 and said throat 200.

Said rotating ginning equipment 300 comprises a picker roller.

Said saw gin stand safety assembly 100 comprises said plurality of side panels 104. Said plurality of side panels 104 comprise said first side panels 104*a*, and said second side panels 104*b*.

Said saw gin stand safety assembly 100 comprises said picker-agitator motor 106, said front panel 108, said frame 110, said hinged lid 112 having said two hinges 114.

Said saw gin stand safety assembly 100 can be configured to further comprise said lower front window 302 in said lower front panel 304. Said lower front window 302 can be arranged to display a status of said saw gin stand safety assembly 100 proximate to said rotating ginning equipment 300 and a lower portion of said throat 200. Said lower front window 302 can be configured to function as a fire door for monitoring the status of said input cotton flow 408, which can be a fire danger in said saw gin stand safety assembly 100.

Said saw gin stand safety assembly 100 comprises said picker roller 300*a* and said agitator 300*b* attached to and driven by said picker-agitator motor 106. Said picker-agitator motor 106 can be configured to drive said picker roller 300*a* and said agitator 300*b* separate from other portions of said saw gin stand safety assembly 100. Wherein, monitoring a load and adjusting a speed of said picker-agitator motor 106, can vary a feed rate of said fibrous material 208 being fed into said saw gin stand safety assembly 100, without slowing said saw blade 300*c* and said blade cleaning brush assembly 300*d*.

Said saw gin stand safety assembly 100 can be configured to mount said picker-agitator motor 106 within said saw gin stand safety assembly 100 and in particular within said lower cavity 416. Said lower cavity 416 can be within said front panel 108 and said hinged lid 112. With said picker-agitator motor 106 within said lower cavity 416, power can be applied to said picker roller 300*a* and said agitator 300*b* without an idler and lengthy belt.

Said throat 200 of said saw gin stand safety assembly 100 comprises 3 to 4 of space above said two hinges 114 and of said throat 200 in said upper cavity 400.

Said saw gin stand safety assembly 100 for holding said fibrous material 208 for ginning with said rotating ginning equipment 300. Said saw gin stand safety assembly 100 comprises said outer shell 102, said throat 200, said picker-agitator motor 106, said amperage draw sensor 410 and said rotating ginning equipment 300. Said rotating ginning equipment 300 comprises at least said picker roller 300*a*. Said amperage draw sensor 410 monitors a power usage of said picker-agitator motor 106. Said saw gin stand safety assembly 100 can be configured to adjust said RPM 414 of said picker-agitator motor 106 according to said amperage draw signal 412 generated by said amperage draw sensor 410. Said throat 200 can be configured for holding said fibrous material 208 comprising cotton during the ginning process. Said saw gin stand safety assembly 100 can be configured for receiving said fibrous material in a portion of said throat 200, channeling said fibrous material 208 downward through said throat 200 into said rotating ginning equipment 300, rotating said picker-agitator motor 106, monitoring said amperage draw signal 412 from said amperage draw sensor 410, and adjusting said RPM 414 of said picker-agitator motor 106 according to said amperage draw signal 412. Said saw gin stand safety assembly 100 comprises said picker roller 300*a* and said agitator 300*b* attached to and driven by said picker-agitator motor 106. Said picker-agitator motor 106 can be configured to drive said picker roller 300*a* and said agitator 300*b* separate from other portions of said saw gin stand safety assembly 100. Wherein, monitoring a load and adjusting a speed of said picker-agitator motor 106, can vary a feed rate of said fibrous material 208 being fed into said saw gin stand safety assembly 100, without slowing said saw blade 300*c* and said blade cleaning brush assembly 300*d*.

Said saw gin stand safety assembly 100 further comprises said amperage draw sensor 410. Said saw gin stand safety assembly 100 can be configured to adjust said RPM 414 of said picker-agitator motor 106 to avoid choaking of said fibrous material 208 in said rotating ginning equipment 300 and said throat 200.

Said controller 406 comprises said address space 600. Said address space 600 comprises said memory 602 comprising said program 604, said processor 606 and said communication hardware 608. Said program 604 can be configured for receiving said amperage draw signal 412 related to said picker-agitator motor 106. Calculating a change in said RPM 414 of said picker-agitator motor 106 to ensure smooth operation of said saw gin stand safety assembly 100 and to minimize clogs of said fibrous material 208 in said throat 200.

Said saw gin stand safety assembly 100 further comprises said amperage draw sensor 410. Said amperage draw sensor 410 can be configured for monitoring power usage by said picker-agitator motor 106. Said amperage draw sensor 410 can be configured for reporting an amperage draw signal to said controller 406. Said controller 406 can reduce or increase said RPM 414 of operation of said picker-agitator motor 106 to minimize clogs of said fibrous material 208 in said rotating ginning equipment 300 and said throat 200.

The following list of the parts is provided for the convenience of the reader:

said saw gin stand safety assembly 100,
said outer shell 102,
said plurality of side panels 104,
said first side panels 104*a*,
said second side panels 104*b*,
said picker-agitator motor 106,
said front panel 108,
said frame 110,
said hinged lid 112,
said two hinges 114,
said throat 200,
said fibrous material 208,
said front window 202,
said two agitator mounting plates 204,
said agitator mounting aperture 206,
said rotating ginning equipment 300,
said picker roller 300*a*,
said lower front window 302,
said lower front panel 304,
said upper cavity 400,
said prior art lid height 402,
said agitator 300*b*,
said saw blade 300*c*,
said blade cleaning brush assembly 300*d*,
said lower cavity 416,
said controller 406,
said input cotton flow 408,
said RPM 414,
said amperage draw sensor 410,
said amperage draw signal 412,
said prior art gin stand 500,
said address space 600,
said memory 602,
said program 604,
said processor 606, and
said communication hardware 608.

The invention claimed is:

1. A saw gin stand safety assembly for holding a fibrous material for ginning with a rotating ginning equipment, wherein:

said saw gin stand safety assembly comprises an outer shell, a throat, a picker-agitator motor, an amperage draw sensor and said rotating ginning equipment;
said rotating ginning equipment comprises at least a picker roller;
said amperage draw sensor monitors a power usage of said picker-agitator motor;
said saw gin stand safety assembly is configured to adjust an RPM of said picker-agitator motor according to an amperage draw signal generated by said amperage draw sensor;
said throat is configured for holding said fibrous material comprising cotton during the ginning process;
said saw gin stand safety assembly is configured for
receiving said fibrous material in a portion of said throat,
channeling said fibrous material downward through said throat into said rotating ginning equipment,
rotating said picker-agitator motor,
monitoring said amperage draw signal from said amperage draw sensor, and
adjusting said RPM of said picker-agitator motor according to said amperage draw signal;
said saw gin stand safety assembly further comprises said amperage draw sensor;
said saw gin stand safety assembly is configured to adjust said RPM of said picker-agitator motor to avoid choaking of said fibrous material in said rotating ginning equipment and said throat;
said saw gin stand safety assembly comprises said picker roller and an agitator attached to and driven by said picker-agitator motor;
said picker-agitator motor is configured to drive said picker roller and said agitator separate from other portions of said saw gin stand safety assembly;
wherein, monitoring a load and adjusting a speed of said picker-agitator motor, can vary a feed rate of said fibrous material being fed into said saw gin stand safety assembly, without slowing a saw blade and a blade cleaning brush assembly.

2. A saw gin stand safety assembly for holding a fibrous material for ginning with a rotating ginning equipment, wherein:

said saw gin stand safety assembly comprises an outer shell, a throat, a picker-agitator motor, an amperage draw sensor and said rotating ginning equipment;
said rotating ginning equipment comprises at least a picker roller;
said amperage draw sensor monitors a power usage of said picker-agitator motor;
said saw gin stand safety assembly is configured to adjust an RPM of said picker-agitator motor according to an amperage draw signal generated by said amperage draw sensor;
said throat is configured for holding said fibrous material comprising cotton during the ginning process; and
said saw gin stand safety assembly is configured for receiving said fibrous material in a portion of said throat, channeling said fibrous material downward through said throat into said rotating ginning equipment, rotating said picker-agitator motor, monitoring said amperage draw signal from said amperage draw sensor, and adjusting said RPM of said picker-agitator motor according to said amperage draw signal.

3. The saw gin stand safety assembly of claim 2, wherein:

said picker-agitator motor and said rotating ginning equipment are in a direct drive relationship.

4. The saw gin stand safety assembly of claim 2, wherein:

said saw gin stand safety assembly further comprises said amperage draw sensor; and said saw gin stand safety assembly is configured to adjust said RPM of said picker-agitator motor to avoid choaking of said fibrous material in said rotating ginning equipment and said throat.

5. The saw gin stand safety assembly of claim 2, wherein:

said saw gin stand safety assembly further comprises a controller having an address space;

said address space comprises a memory comprising a program, a processor and a communication hardware;

said program is configured for receiving said amperage draw signal related to said picker-agitator motor; and calculating a change in said RPM of said picker-agitator motor to ensure smooth operation of said saw gin stand safety assembly and to minimize clogs of said fibrous material in said throat.

6. The saw gin stand safety assembly of claim 5, wherein:

said saw gin stand safety assembly further comprises said amperage draw sensor;

said amperage draw sensor is configured for monitoring power usage by said picker-agitator motor;

said amperage draw sensor is configured for reporting an amperage draw signal to said controller; and said controller can reduce or increase said RPM of operation of said picker-agitator motor to minimize clogs of said fibrous material in said rotating ginning equipment and said throat.

7. The saw gin stand safety assembly of claim 2, wherein:

said saw gin stand safety assembly comprises a plurality of side panels; and said plurality of side panels comprise a first side panels, and a second side panels.

8. The saw gin stand safety assembly of claim 2, wherein:

said saw gin stand safety assembly comprises said picker-agitator motor, a front panel, a frame, a hinged lid having two hinges.

9. The saw gin stand safety assembly of claim 2, wherein:

said saw gin stand safety assembly is configured to further comprise a lower front window in a lower front panel;

said lower front window is arranged to display a status of said saw gin stand safety assembly proximate to said rotating ginning equipment and a lower portion of said throat; and said lower front window is configured to function as a fire door for monitoring the status of an input cotton flow, which is a fire danger in said saw gin stand safety assembly.

10. The saw gin stand safety assembly of claim 2, wherein:

said saw gin stand safety assembly comprises said picker roller and an agitator attached to and driven by said picker-agitator motor;

said picker-agitator motor is configured to drive said picker roller and said agitator separate from other portions of said saw gin stand safety assembly;

wherein, monitoring a load and adjusting a speed of said picker-agitator motor, can vary a feed rate of said fibrous material being fed into said saw gin stand safety assembly, without slowing a saw blade and a blade cleaning brush assembly.

11. The saw gin stand safety assembly of claim 2, wherein:

said saw gin stand safety assembly is configured to mount said picker-agitator motor within said saw gin stand safety assembly and within a lower cavity;

said lower cavity is within a front panel and a hinged lid; and with said picker-agitator motor within said lower cavity, power is applied to said picker roller and said agitator without an idler and belt.

12. The saw gin stand safety assembly of claim 2, wherein:

said saw gin stand safety assembly comprises a hinged lid having two hinges; and said throat of said saw gin stand safety assembly comprises an additional 3 to 4 inches of clearance above said two hinges and within said upper cavity.

13. A saw gin stand safety assembly for holding a fibrous material for ginning with a rotating ginning equipment, wherein:

said saw gin stand safety assembly comprises an outer shell, a throat, a picker-agitator motor, an amperage draw sensor and said rotating ginning equipment;

said rotating ginning equipment comprises at least a picker roller;

said amperage draw sensor monitors a power usage of said picker-agitator motor;

said saw gin stand safety assembly is configured to adjust an RPM of said picker-agitator motor according to an amperage draw signal generated by said amperage draw sensor;

said throat is configured for holding said fibrous material comprising cotton during the ginning process;

said saw gin stand safety assembly is configured for receiving said fibrous material in a portion of said throat, channeling said fibrous material downward through said throat into said rotating ginning equipment, rotating said picker-agitator motor, monitoring said amperage draw signal from said amperage draw sensor, and adjusting said RPM of said picker-agitator motor according to said amperage draw signal;

said saw gin stand safety assembly comprises said picker roller and an agitator attached to and driven by said picker-agitator motor;

said picker-agitator motor is configured to drive said picker roller and said agitator separate from other portions of said saw gin stand safety assembly; and wherein, monitoring a load and adjusting a speed of said picker-agitator motor, can vary a feed rate of said fibrous material being fed into said saw gin stand safety assembly, without slowing a saw blade and a blade cleaning brush assembly.

14. The saw gin stand safety assembly of claim 13, wherein:

said saw gin stand safety assembly further comprises said amperage draw sensor; and said saw gin stand safety assembly is configured to adjust said RPM of said picker-agitator motor to avoid choaking of said fibrous material in said rotating ginning equipment and said throat.

15. The saw gin stand safety assembly of claim 13, wherein:

said saw gin stand safety assembly further comprises a controller having an address space;

said address space comprises a memory comprising a program, a processor and a communication hardware;

said program is configured for receiving said amperage draw signal related to said picker-agitator motor; and calculating a change in said RPM of said picker-agitator motor to ensure smooth operation of said saw gin stand safety assembly and to minimize clogs of said fibrous material in said throat.

16. The saw gin stand safety assembly of claim 15, wherein:

said saw gin stand safety assembly further comprises said amperage draw sensor;

said amperage draw sensor is configured for monitoring power usage by said picker-agitator motor;

said amperage draw sensor is configured for reporting an amperage draw signal to said controller; and said controller can reduce or increase said RPM of operation of said picker-agitator motor to minimize clogs of said fibrous material in said rotating ginning equipment and said throat.

17. The saw gin stand safety assembly of claim 13, wherein:

said saw gin stand safety assembly is configured to mount said picker-agitator motor within said saw gin stand safety assembly and within a lower cavity;

said lower cavity is within a front panel and a hinged lid; and with said picker-agitator motor within said lower cavity, power is applied to said picker roller and said agitator without an idler and belt.

* * * * *